US006318105B1

(12) United States Patent
Bushnell et al.

(10) Patent No.: US 6,318,105 B1
(45) Date of Patent: Nov. 20, 2001

(54) CONTROL BOX FOR A ROOM AIR CONDITIONER

(75) Inventors: Peter R. Bushnell, Cazenovia, NY (US); Nestor Hernandez, Nuevo Leon (MX); Juan C. C. Correa, Porto Alegre (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/641,237

(22) Filed: Aug. 17, 2000

(51) Int. Cl.[7] ..... F25D 23/12
(52) U.S. Cl. ..... 62/262; 62/298
(58) Field of Search ..... 62/262, 298

(56) References Cited

U.S. PATENT DOCUMENTS 5,868,617 * 2/1999 Kim ..... 454/324
5,896,921 * 4/1999 Lee ..... 165/149
6,009,717 * 1/2000 Hernandez et al. ..... 62/262
6,085,538 * 7/2000 Bascaran et al. ..... 62/262
6,182,460 * 2/2001 Hernandez et al. ..... 62/262

* cited by examiner

*Primary Examiner*—William Doerrler
*Assistant Examiner*—Mark S. Shulman

(57) ABSTRACT

A control for an air conditioning unit, which is configured to be easily attached to a vertically extending partition of the air conditioning unit. The control box includes a main housing having a substantially horizontal bottom wall. The bottom wall has front, side and rear edges and a front wall extending substantially vertically upwardly from the front edge of the bottom wall. A side wall extends substantially vertically upwardly from each of the side edges of the bottom wall. Each of the side walls has a front edge integrally formed with the front wall and a rear edge having a downwardly extending attachment hook extending rearwardly of the rear edge of the side wall and the rear edge of the bottom wall. The air conditioner's partition has attachment hook receiving slots formed therein, which are configured to receive the attachment hooks therein in a manner attaching the main housing to the partition with the rear edges of the bottom wall and the side wall in confronting relation with the partition.

4 Claims, 7 Drawing Sheets

CONTROL BOX FOR A ROOM AIR CONDITIONER

BACKGROUND OF THE INVENTION

The present invention is directed to air conditioners and, more particularly, to a control box for a room air conditioning unit.

Air conditioning units such as so called "window room air conditioners" are commonly used for residential and similar applications and generally include closed refrigeration circuits having an evaporator and a condenser. The unit is normally divided by a partition into an evaporator section and a condenser section. The evaporator section communicates with the room air to be conditioned and the condenser section communicates with external air such as outdoor air. Refrigerant flows through a refrigerant circuit absorbing heat from room air at the evaporator and discharging heat energy to the external air at the condenser. The conventional refrigerated circuit is completed by the addition of a compressor, an expansion device and the appropriate interconnections between the components.

Such an air conditioning unit usually includes a basepan supporting all of the components and an outer housing surrounding the entire unit. The front of the evaporator, or indoor section, includes an indoor grille, which has openings therein for directing warm indoor air into the evaporator and discharge openings therein for directing air back into the room. The outdoor section of the housing includes a plurality of openings in the sides and top thereof, which serve as inlet openings for cooling air which flows into the outdoor section and outwardly therefrom after passing through the condenser coil, which is mounted vertically in the back of the outdoor section.

The indoor grille also includes an opening therein for the control panel upon which are mounted control knobs, buttons, switches and the like for facilitating adjustment of the air conditioning unit's function and temperature level control. The control panel and the control components associated therewith are typically mounted to a control box for the unit in which are housed other components associated with the electrical system of the air conditioning unit.

In order to reduce the high cost of labor in the manufacture of an air conditioning unit, it is considered desirable to minimize the number of components of the unit and to make the installation of those components involve as few steps as possible. Also, in the control box for an air conditioning unit it is considered desirable to have easy access to the interior of the control box to facilitate not only initial assembly but subsequent access for service of the components contained therein.

SUMMARY OF THE INVENTION

A control for an air conditioning unit, which is configured to be easily attached to a vertically extending partition of the air conditioning unit. The control box includes a main housing having a substantially horizontal bottom wall. The bottom wall has front, side and rear edges and a front wall extending substantially vertically upwardly from the front edge of the bottom wall. A side wall extends substantially vertically upwardly from each of the side edges of the bottom wall. Each of the side walls has a front edge integrally formed with the front wall and a rear edge having a downwardly extending attachment hook extending rearwardly of the rear edge of the side wall and the rear edge of the bottom wall. The air conditioner's partition has attachment hook receiving slots formed therein, which are configured to receive the attachment hooks therein in a manner attaching the main housing to the partition with the rear edges of the bottom wall and the side wall in confronting relation with the partition.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENTS

Figure 1:
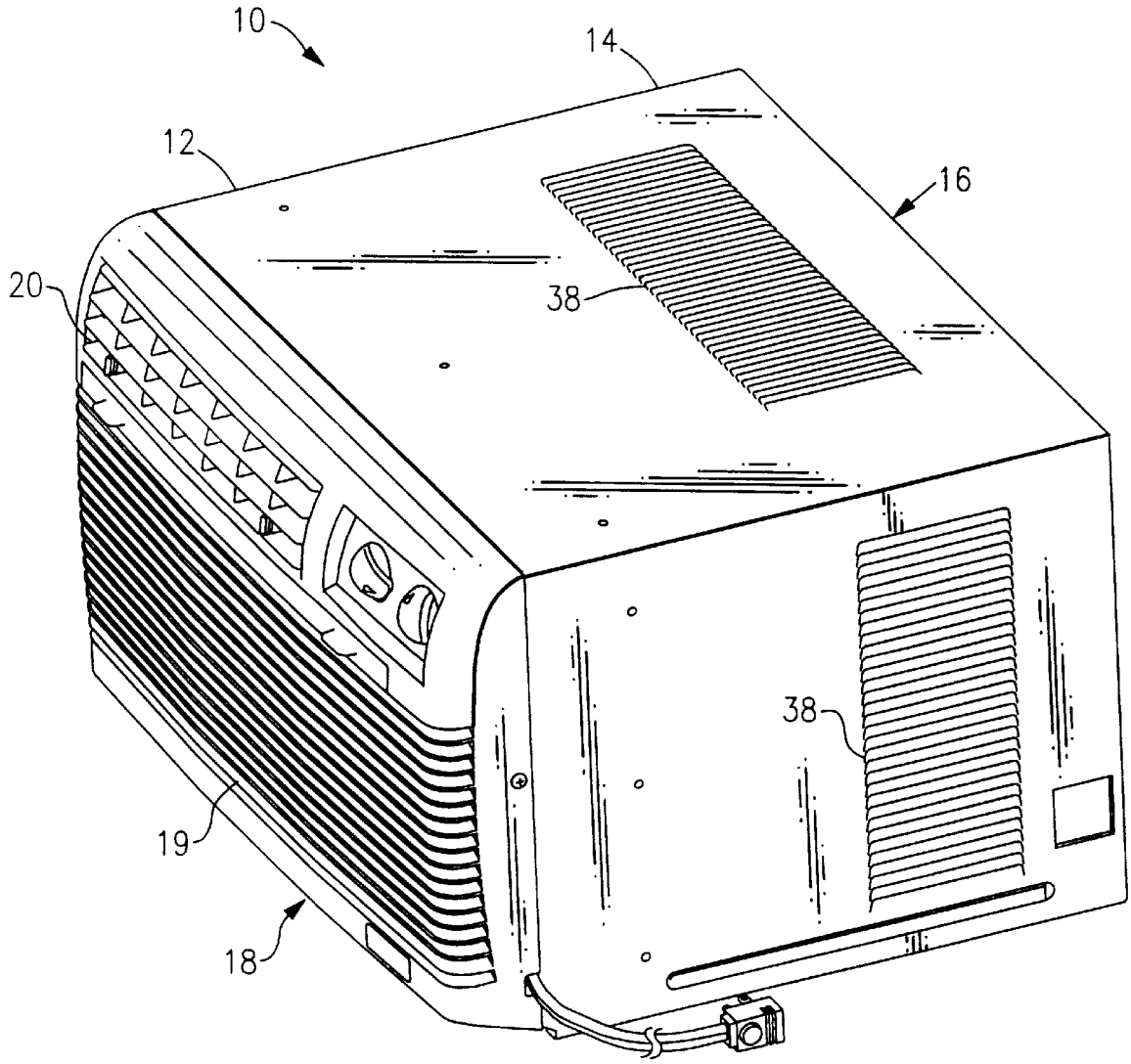
FIG. 1 is a perspective view of a room air conditioner, which embodies the features of this invention.

FIG. 1 illustrates an air conditioning unit 10, which includes, generally, an indoor section 12 and an outdoor section 14. The room air conditioner is enclosed in a substantially rectangular housing 16 and is adapted to be positioned in a rectangular opening in an exterior wall or in a window in a room where cooling is desired with the indoor section 12 facing into the room, as is conventional. The indoor section 12 includes an indoor grille section 18, which includes inlet louvers 19 and air discharge assembly 20. The front grille 18 also includes a rectangular opening 21 in the upper right-hand corner, which surrounds the control panel for the unit, as will be described in detail below.

Figure 2:
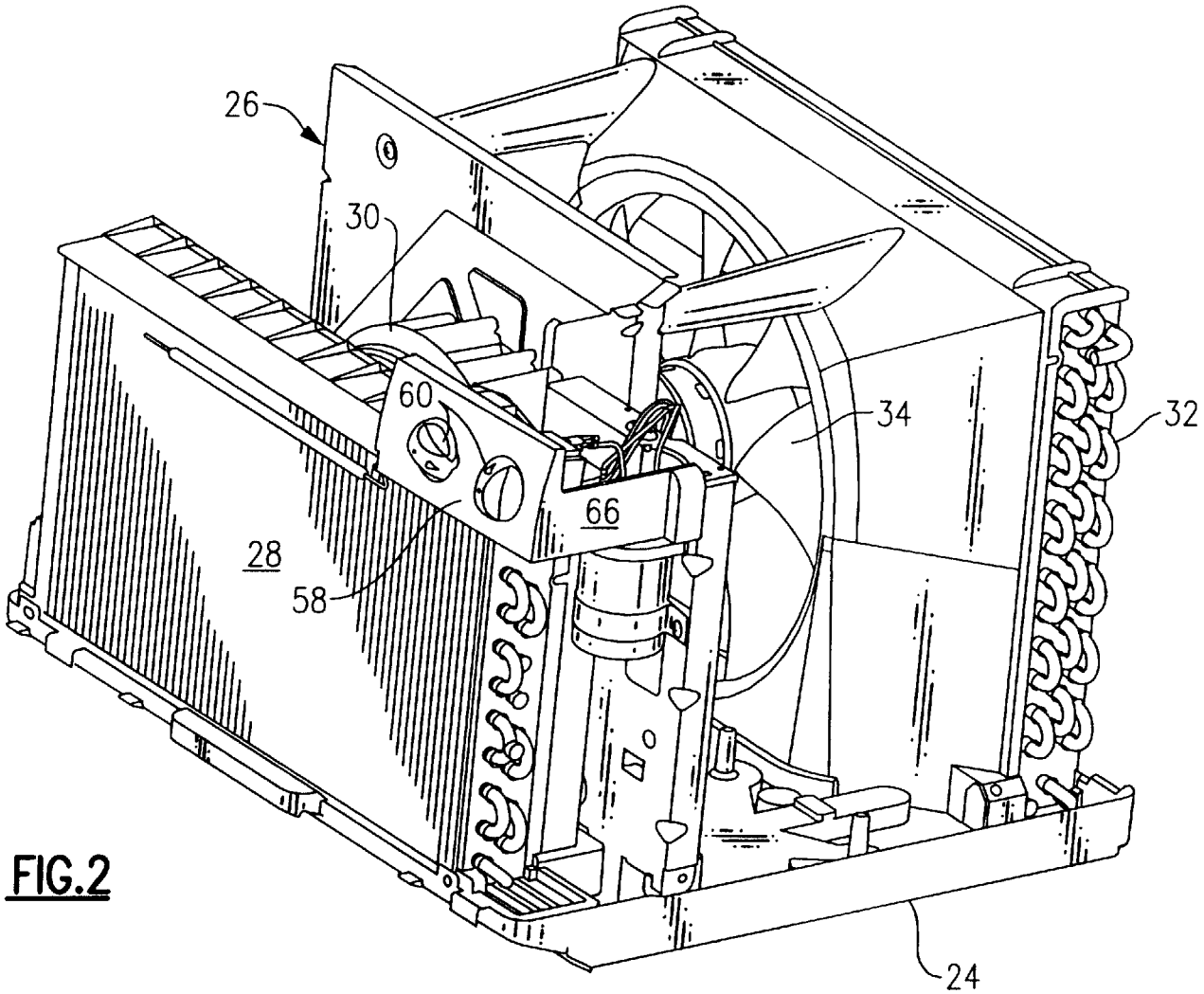
FIG. 2 is a perspective view of the air conditioning unit of FIG. 1 with the outer cover and front grille removed therefrom.

Looking now at FIG. 2, the components of both the indoor section 12 and outdoor section 14 are supported in a rectangular basepan 24. The indoor and outdoor sections are separated by a vertically extending metal partition 26, which is illustrated in more detail in FIGS. 4, 6 and 7. The indoor section includes an evaporator coil 28 vertically disposed at the front end thereof and an evaporator indoor fan 30 located behind the evaporator 28. The outdoor section 14 includes a condenser coil 32 vertically disposed adjacent the back end thereof and a condenser fan 34 located within the indoor section adjacent the condenser coil. The unit's compressor 36 is also located in the outdoor section 14. The condenser coil 32 is fluidly interconnected with the compressor 36 and the evaporator 28 in a conventional manner to provide cooling to the room in which the unit is installed.

During operation, air from the space to be conditioned by the unit is drawn by action of the evaporator fan 30 through the inlet louvers 19 and is directed through the evaporator coil 28 where the air is cooled. The cooled air is then directed back into the room to be cooled through the air discharge assembly 20. At the same time, ambient air is drawn through inlets 38 in the outside section of the housing 16 by operation of the condenser fan 34 and is directed through the condenser coil 32 before exiting from the back side of the condenser coil.

With reference now generally to the drawing figures, the aforementioned control panel forms a part of a control box 40 which is attached to a generally planar section 42 of the metal partition 26. The control box 40 includes a main housing 44 and a cover 46.

The main housing 44 includes a substantially horizontal bottom wall 48, which defines a front edge 50, left and right side edges 52 and 54, respectively, and a rear edge 56. A curvilinear-shaped front wall 58 extends substantially vertically upwardly from the front edge. The front wall 58 defines the aforementioned control panel having control knobs 60 positioned thereupon, which are attached to thermostat and function switches 62 mounted to the rear of the wall in the interior of the control box.

Left side wall 64 and right side wall 66 extend vertically upwardly from the left edge 52 and the right edge 54 of the bottom wall, respectively. Each of the left and right side walls 64 and 66 is integrally formed with the front wall 58 at the front thereof and defines a rear edge 68 on the left wall and 70 on the right wall. Extending rearwardly from each of the side walls' rear edges 68 and 70 are a pair of downwardly extending hooks 72 and 74, respectively.

Figure 6:
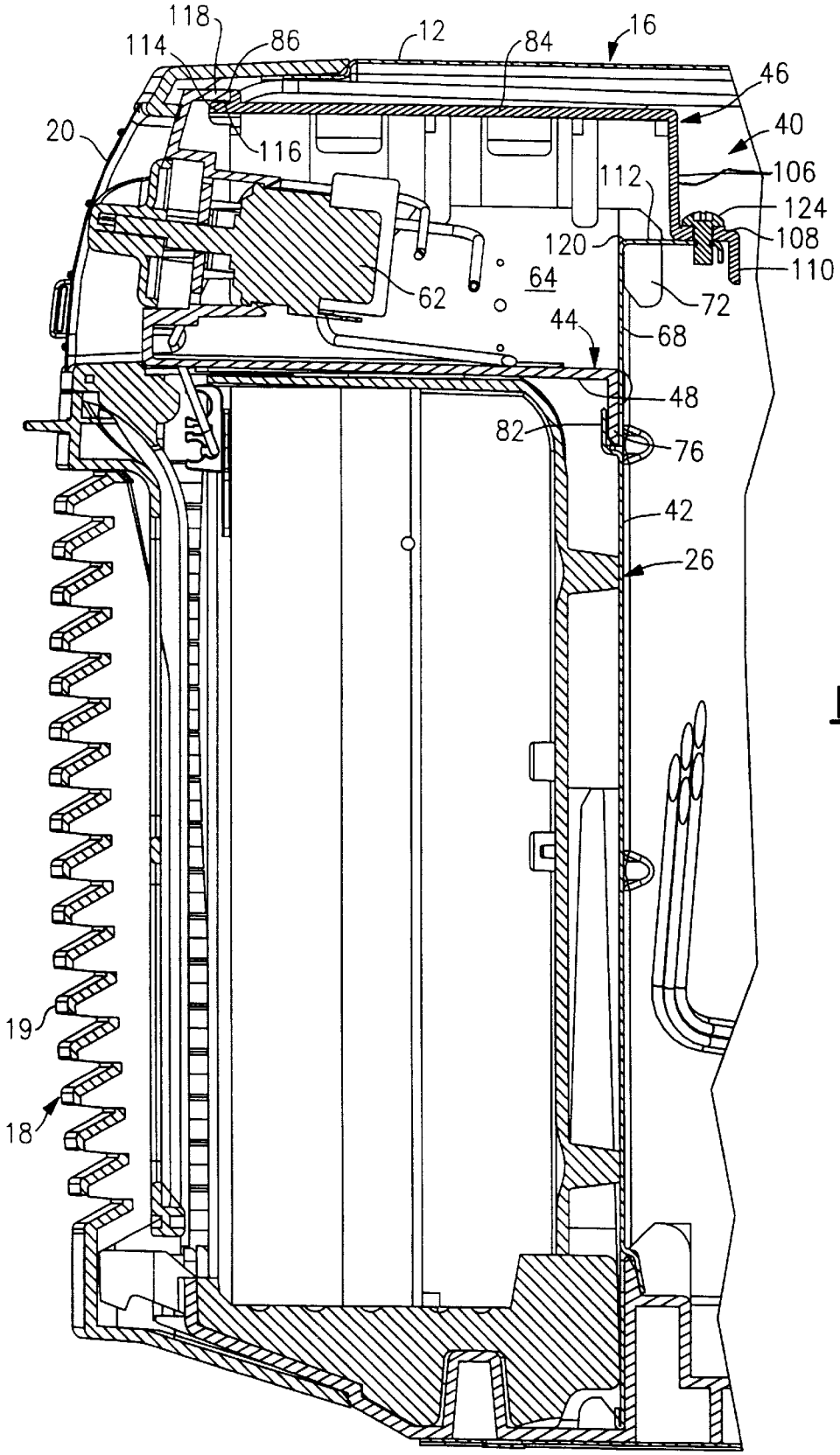
FIG. 6 is a sectional view taken along the line 6—6 of FIG. 5.
Figure 11:
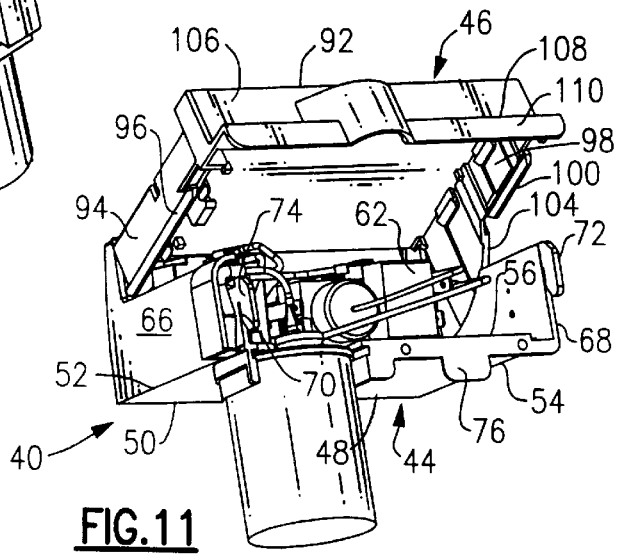
FIG. 11 is a view of the control box as illustrated in FIG. 9 taken from the rear thereof.

Extending downwardly from the rear edge 56 of the bottom wall 48 (as best seen in FIGS. 6 and 11) is a mounting tab 76. It should be noted that the attachment hooks 72 and 74 extend from the upper ends of the rear edges of the side walls and extend rearwardly of the edges while the mounting tab 76 lies in the plane defined by the rearwardly facing edges of the bottom wall and the side walls.

Figure 4:
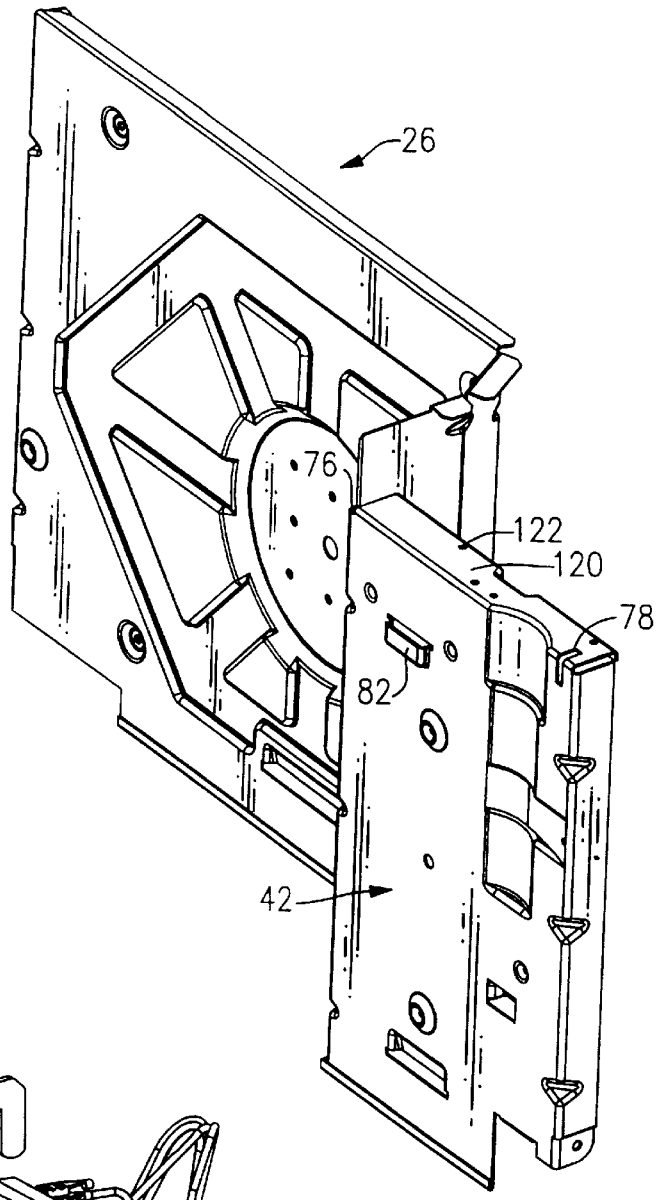
FIG. 4 is an enlarged perspective view of the partition upon which the control box is mounted.
Figure 3:
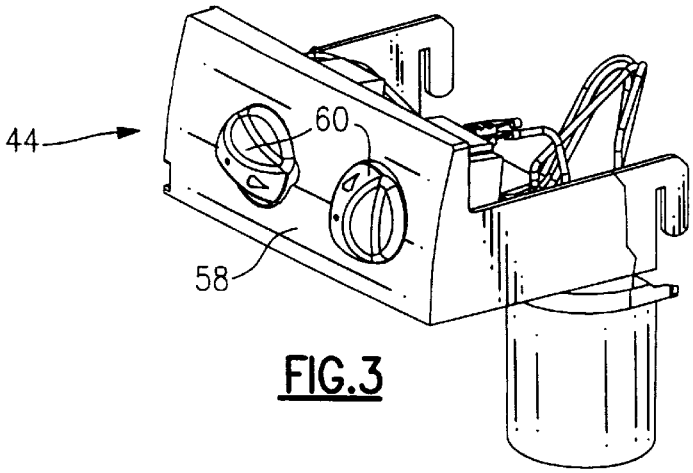
FIG. 3 is an enlarged perspective view of the main housing of the control box of the present invention.
Figure 5:
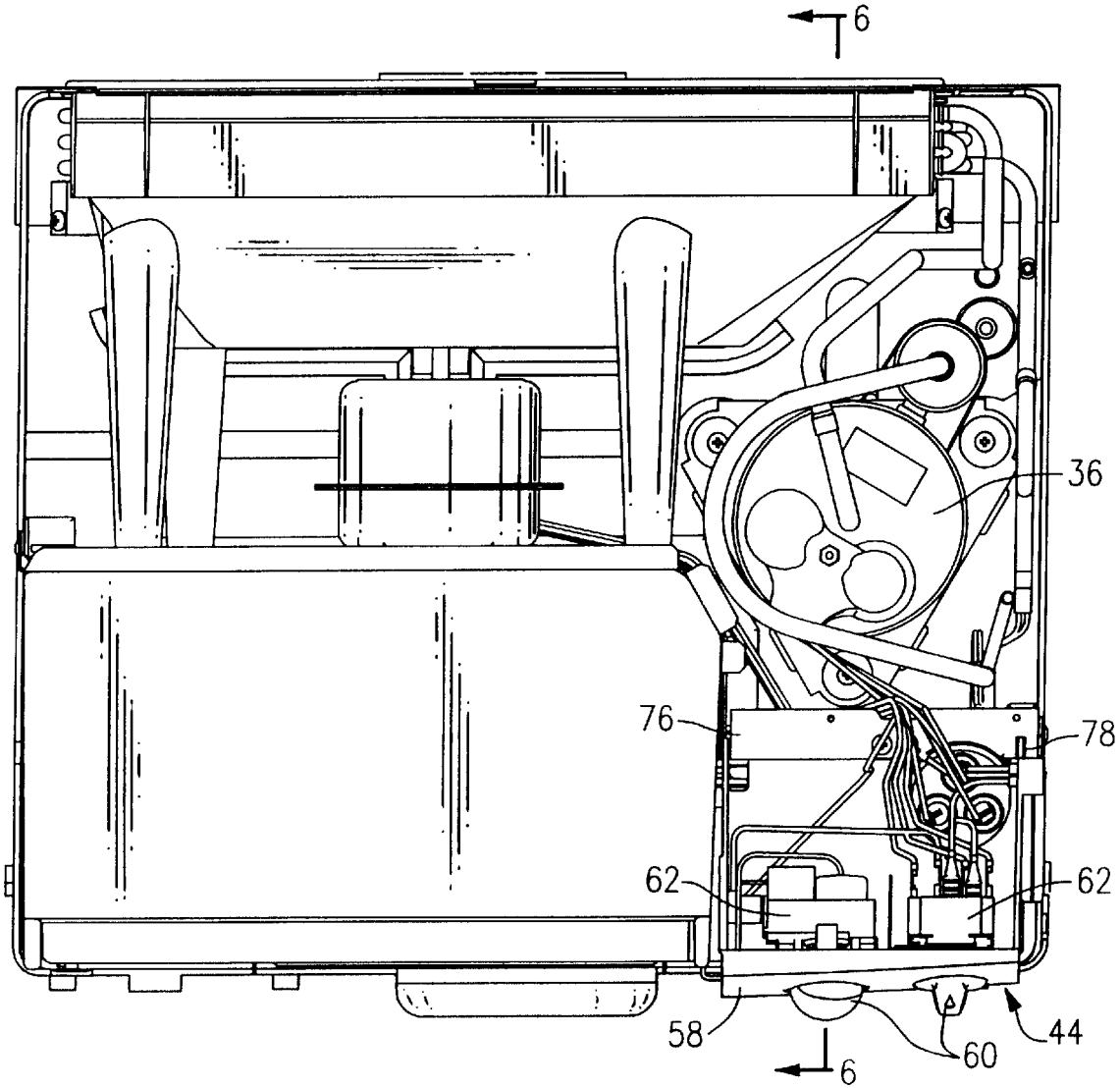
FIG. 5 is a top plan view of the air conditioning unit illustrated in FIG. 2.

As best seen in FIGS. 4 and 6, the planar section 42 of the partition 26 is provided with a right-hand slot 78 and a left-hand slot 80, which are adapted to receive the lefthand hook 72 and the right-hand hook 74 therein. Planar section 42 also is provided with a structural conformation 82 forming a pocket, which is configured to receive the mounting tab 76 therein.

Figure 7:
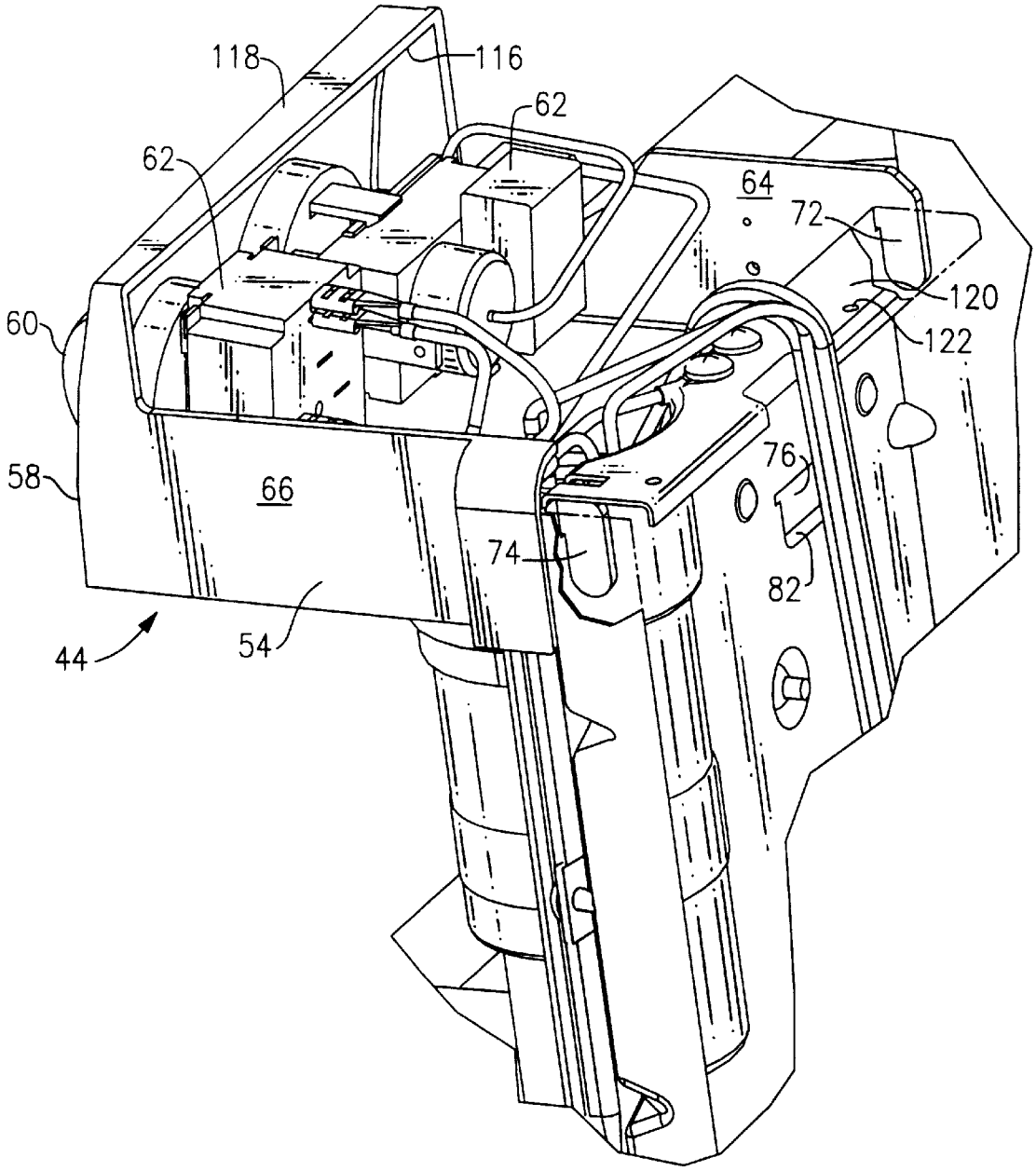
FIG. 7 is an enlarged rear perspective view, partially broken away showing the attachment details of the control box main housing to the partition.

It should be appreciated that installation of the main housing 44 to the partition is carried out by positioning the hooks 72, 74 and the mounting tab 76 vertically above their respective mating structures and displacing the housing vertically downwardly to result in the engagement of these components, as best illustrated in FIGS. 6 and 7. As will now be seen, attachment of the entire control box 40 including the housing 44 is achieved by installation of the cover member 46 and a single threaded fastener.

The control box cover 46 is shown attached to the main housing 44 and the partition 42 in FIG. 6 and is shown from various angles in FIGS. 8, 9, 10 and 11.

The control box cover 46 includes a substantially horizontal top wall 84, which defines a front edge 86, a left side edge 88, a right side edge 90 and a rear edge 92. A right side wall 94 extends downwardly for the right edge 90 and defines a skirt portion 96 at the lower end thereof. A left side wall 98 extends downwardly from the right side edge 90 and defines a shortened skirt section 100 adjacent the rear edge thereof and an extended section 102 which defines an arcuate downwardly and rearwardly facing edge 104.

A rear wall 106 extends downwardly from the rear edge 92 of the top wall of the cover. The rear wall has formed at its lower end a substantially horizontal rearwardly extending ledge 108. A downwardly extending skirt section 110 extends from the rear edge of the ledge 108. The horizontal ledge 108 has a through opening 112 formed therein.

Figure 8:
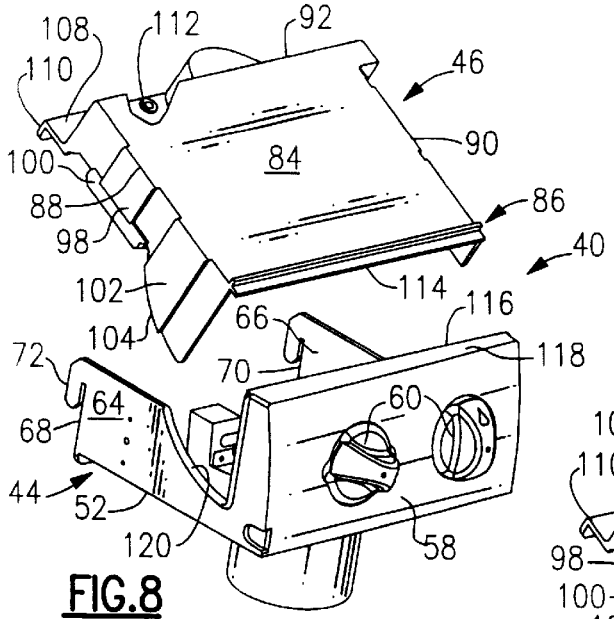
FIG. 8 is an exploded front perspective view of the control box of the present invention.
Figure 9:
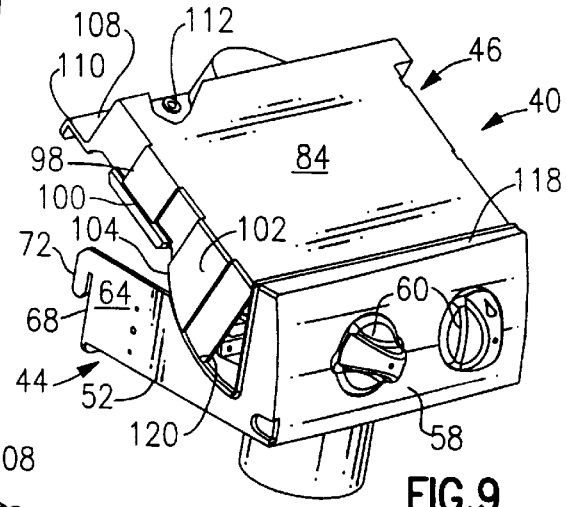
FIG. 9 is a view similar to FIG. 8 showing the control box cover partially installed to the main housing.
Figure 10:
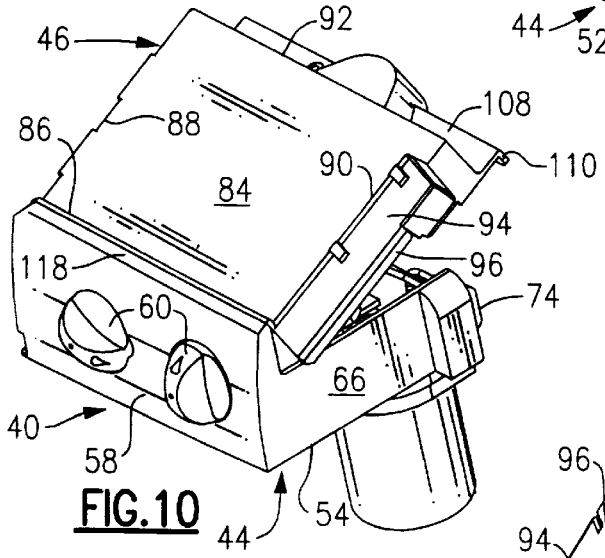
FIG. 10 is a view of the control box as illustrated in FIG. 9 taken from the front right-hand side thereof.

Extending forwardly from the front edge 86 of the top wall is a longitudinally extending tab 114. As best seen in FIGS. 8 and 9, installation of the top cover 46 to the main housing 44 is achieved by placing the longitudinally extending tab 114 under a longitudinally extending lip 116 formed by a rearwardly extension 118 from the top edge of the front wall 58 of the main housing. The tab 114 and the lip 116 are configured such that when they are engaged, as illustrated in FIG. 9, the arcuate edge 104 of the extension 102 in the cover 46 will engage a mating arcuate surface 120 formed in the left-hand side wall 64 of the housing 44. Such engagements facilitate a smooth pivotal movement of the cover about the engagement of the lip and the extension downwardly until the horizontal ledge 108 of the cover comes in contact with a horizontal wall section 120 formed at the top of the planar section 42 of the partition, as best seen in FIGS. 6 and 7. The horizontal section 120 is provided with a through opening therein 122, which is in axial alignment with the opening 112 in horizontal ledge 108 of the cover when installed. A single threaded fastener 124 is adapted to be passed through the opening in the horizontal ledge 108 and to be threadably received in the opening 122 in the horizontal section 120 to thereby securely attach the cover to the partition and to thereby securely attach the entire control box to the partition.

As so engaged, the skirt portions 96, 100 and 110 formed on the cover overlap with corresponding structure on the housing and the partition to assure a weatherproof engagement therebetween.

What is claimed is:

1. A control box for an air conditioner, the air conditioner having a vertically extending partition to which the control box is mounted, wherein the improvement comprises:

a main housing having a substantially horizontal bottom wall, said bottom wall having front, side and rear edges thereof, a front wall extending upwardly from said front edge of said bottom wall;

a side wall extending substantially vertically upwardly from each of said side edges of said bottom wall, each of said side walls having a front edge integrally formed with said front wall and a rear edge having a downwardly extending attachment hook extending rearwardly of said rear edge of said side wall and said rear edge of said bottom wall;

said partition having attachment hook receiving slots formed therein which are configured to receive said attachment hooks therein in a manner attaching said main housing to said partition with said rear edges of said bottom wall and said side wall in confronting relation with said partition.

2. The control box of claim 1 wherein said attachment hooks extend from the upper end of said side walls and further including a mounting tab extending downwardly from said rear edge of said bottom wall in substantially parallel relationship to said partition;

said partition having mounting tab receiving structure formed therein configured to receive said mounting tab therein when said attachment hooks are received in said receiving slots.

3. The control box of claim 2 wherein said front wall of said housing has a substantially horizontally, rearwardly extending lip formed thereon, and wherein said partition has a substantially horizontal mounting surface extending rearwardly from its upper end;

and further including a control box cover, said cover comprising a substantially horizontal top wall having front, side, and rear edges thereof, said top wall having a forwardly extending longitudinally extending tab formed at said front edge thereof;

said cover further including a rear wall extending substantially vertically downwardly from said rear edge of said top wall, said rear wall including a substantially horizontal, rearwardly extending ledge formed at the lower end thereof;

said cover, said main housing and said partition being configured such that when said main housing is attached to said partition by said attachment hooks and said mounting tab, said cover may be installed by positioning said horizontal tab of said front wall of said cover under said lip of said front wall of said housing, and further positioning said ledge of said rear wall of said cover in overlying relationship with said horizontal mounting surface of said partition; and further wherein said ledge and said mounting surface have axially aligned openings formed therein configured to receive a threaded fastener therein to interconnect said cover to said partition and thereby affix said control box to said partition.

4. The control box or claim 3 wherein said engagement of said horizontal tab of said cover and said lip of said housing defines a pivot point between said cover and said housing, and, wherein one of said side walls of said housing defines an arcuate surface facing said pivot point, said arcuate surface having a radius of curvature that equals the distance between said arcuate surface and said pivot point; and wherein one of said side walls of said cover defines an arcuate surface complementary to said arcuate surface of said housing, said arcuate surfaces being configured to engage one another to guide pivotal movement of said cover with respect to said housing when assembling said control box.

* * * * *